US008135291B2

(12) United States Patent
Chihara

(10) Patent No.: US 8,135,291 B2
(45) Date of Patent: Mar. 13, 2012

(54) CONSUMABLE PART FOR AN IMAGE FORMING APPARATUS AND A CONTROL METHOD THEREOF

(75) Inventor: Hiroshi Chihara, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 741 days.

(21) Appl. No.: 12/182,534

(22) Filed: Jul. 30, 2008

(65) Prior Publication Data

US 2009/0034994 A1 Feb. 5, 2009

(30) Foreign Application Priority Data

Jul. 31, 2007 (JP) ..... 2007-199898

(51) Int. Cl.
*G03G 15/00* (2006.01)

(52) U.S. Cl. ..... 399/24; 399/25

(58) Field of Classification Search ..... 399/24, 399/25

See application file for complete search history.

(56) References Cited

U.S. PATENT DOCUMENTS

| | | | | |
|---|---|---|---|---|
| 5,502,830 | A * | 3/1996 | Aihara | 711/217 |
| 5,752,125 | A * | 5/1998 | Yamashita et al. | 399/8 |
| 5,873,009 | A * | 2/1999 | Yamashita et al. | 399/8 |
| 5,883,722 | A * | 3/1999 | Baumler | 358/296 |
| 6,188,852 | B1 * | 2/2001 | Ojima et al. | 399/25 |
| 6,196,670 | B1 | 3/2001 | Saruta | |
| 7,134,738 | B2 | 11/2006 | Saruta | |
| 2001/0005457 | A1 * | 6/2001 | Serizawa | 399/12 |
| 2003/0228161 | A1 * | 12/2003 | Chihara | 399/27 |
| 2008/0005453 | A1 * | 1/2008 | Mizuyama | 711/103 |
| 2009/0268248 | A1 * | 10/2009 | Furukawa | 358/1.16 |
| 2009/0327804 | A1 * | 12/2009 | Moshayedi | 714/8 |
| 2010/0064111 | A1 * | 3/2010 | Kunimatsu et al. | 711/161 |

FOREIGN PATENT DOCUMENTS

| | | | |
|---|---|---|---|
| JP | 04-015893 | | 1/1992 |
| JP | 05-027502 | | 2/1993 |
| JP | 2001-312110 | | 11/2001 |
| JP | 2003019815 | A * | 1/2003 |
| JP | 2003019818 | A * | 1/2003 |
| JP | 2004074711 | A * | 3/2004 |

OTHER PUBLICATIONS

English machine translation of Chihara (JP pub 2004-074711).*

* cited by examiner

*Primary Examiner* — David Gray
*Assistant Examiner* — Geoffrey Evans
(74) *Attorney, Agent, or Firm* — Canon U.S.A., Inc. I.P. Division

(57) ABSTRACT

An image forming apparatus includes a detachable consumable part having a storage unit configured to store information. The image forming apparatus includes a counting unit configured to count the number of times of access to the storage unit, a measurement unit configured to measure a used amount of the consumable part, and an access control unit configured to control an access frequency to the storage unit based on the counted number of times of access and the used amount of the consumable part.

10 Claims, 7 Drawing Sheets

CONSUMABLE PART FOR AN IMAGE FORMING APPARATUS AND A CONTROL METHOD THEREOF

BACKGROUND OF THE INVENTION

1. Field of the Invention

The present invention relates to an image forming apparatus that includes a consumable part such as a cartridge having a storage unit like a nonvolatile memory, and a control method of the image forming apparatus.

2. Description of the Related Art

Conventionally, in copying machines or laser beam printers that use electrophotographic technologies, various components used for image formation are integrally formed as a cartridge. Such a cartridge is consumable, and is replaced when it reaches the end of its lifetime.

Some of such cartridges have a built-in nonvolatile memory (for example, an electrically erasable programmable read-only memory (EEPROM)). The cartridge having a built-in memory stores information about a lifetime of the cartridge, for example, cumulative length of the rotation time of a photosensitive drum which is a component of the cartridge, and a remaining amount of toner. A printer control unit reads the stored information about the lifetime of the cartridge, determines the consumed amount of the cartridge, and changes print conditions or the like.

Japanese Patent Application Laid-Open No. 2001-312110 proposes a method for storing in a memory the number of times of image formation that has been accumulated. Based on the accumulated number of times of image formation, transfer bias is changed to form an image of stable quality. Japanese Patent Application Laid-Open No. 05-027502 proposes a method for determining a lifetime of a process cartridge. In a case where the process cartridge is used so long that the print quality cannot be maintained anymore, the life-end information is stored in the memory, and a user is notified that the process cartridge has reached the end of its life.

Not only the cartridges, but also the memories such as the EEPROM have their lifetime. That is, these memories have upper limits in the number of times of rewrite. The upper limits are generally called the guaranteed number of times of rewrite. Meanwhile, in recent years, as processing speeds of the image forming apparatuses are enhanced, capacities of the process cartridges are largely increased, and the number of times of rewrite of the memories is also being increased. To cope with the increase of the number of times of rewrite, for example, a higher-performance memory that can be more frequently rewritten can be employed. However, in this way, the memory cost increases. Furthermore, as the memory cost increases, a cost of the cartridge which is a consumable part also increases.

If the number of times of rewrite can be reduced, the above-described problems can be solved. For example, if data can be rewritten in a lump for certain volume of the print sheets, the number of times of memory rewrite can be reduced. However, if a power of an apparatus is turned off before the rewrite of the memory is completed, the data rewrite cannot be executed, and the accuracy (reliability) of the data may be lowered.

Further, the memory is mounted on the cartridge and replaced together with the cartridge. When the lifetime of the cartridge ends, the memory may be still usable. That is a wasteful way from the viewpoint of costs. Thus, if it is possible to make the end of the lifetime of the cartridge close to the end of the lifetime of the memory as much as possible, the memory can be effectively used.

SUMMARY OF THE INVENTION

The present invention is directed to increase data accuracy as much as possible while a lifetime of a storage unit such as a memory is maintained until a lifetime of a cartridge ends.

According to an aspect of the present invention, an image forming apparatus includes a detachable consumable part having a storage unit configured to store information. The image forming apparatus includes a counting unit configured to count the number of times of access to the storage unit, a measurement unit configured to measure a used amount of the consumable part, and an access control unit configured to control an access frequency to the storage unit based on the counted number of times of access and the used amount of the consumable part.

According to another aspect of the present invention, a method for controlling access to a storage unit provided in a detachable consumable part in an image forming apparatus, includes measuring a used amount of the consumable part, counting the number of times of access to the storage unit, and controlling an access frequency to the storage unit based on the counted number of times of access and the used amount of the consumable part.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
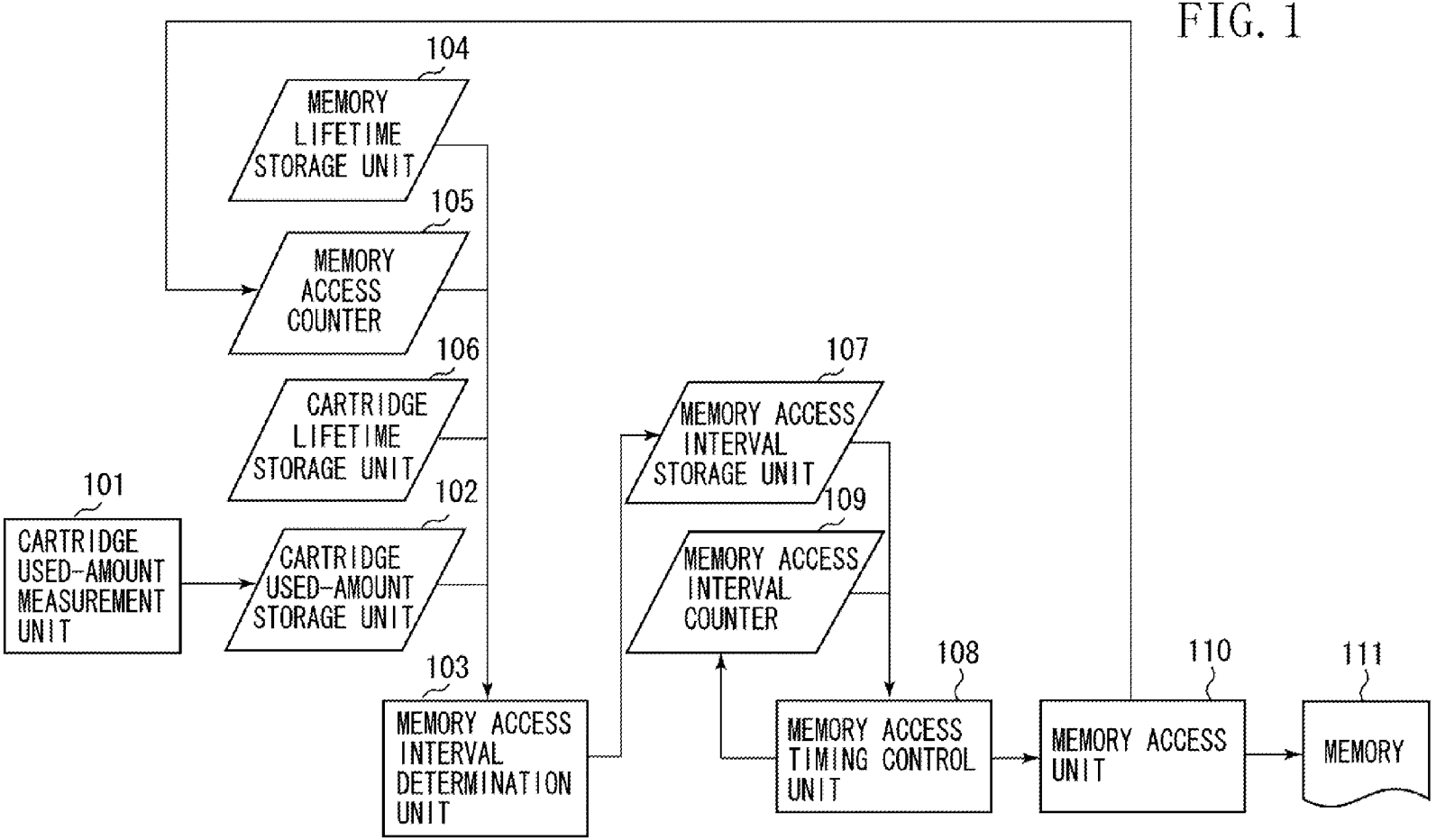
FIG. 1 is a block diagram illustrating a part of a control unit in an image forming apparatus according to a first exemplary embodiment of the present invention.

FIG. 1 is a block diagram illustrating a part of a control unit in an image forming apparatus according to a first exemplary embodiment of the present invention. As an example of a consumable part that can be mounted on or removed from a body of the image forming apparatus, a cartridge that contains developer (for example, toner) is described. The cartridge includes a built-in memory (storage unit) 111. The image forming apparatus can be realized, for example, as a printing apparatus, a printer, a multifunction peripheral, or a facsimile machine. Each unit in FIG. 1 can be realized using one or more of a central processing unit (CPU), a random access memory (RAM), a read only memory (ROM), a computer program, an application specific integrated circuit (ASIC), and a logic circuit. Further, except for a memory 111, each unit can be disposed in the body of the image forming apparatus or in the consumable part.

A cartridge used-amount measurement unit 101, in order to determine a lifetime of the cartridge, measures a current used amount (consumed amount) of the cartridge, and writes the measurement result as cartridge used-amount information in a cartridge used-amount storage unit 102. The cartridge used-amount measurement unit 101 is an example of a measurement unit that measures a used amount of a consumable part. For the cartridge used-amount measurement unit 101, for example, a method discussed in Japanese Patent Application Laid-Open No. 2000-275950 can be used. In the method discussed therein, an electrostatic capacity in a cartridge is detected, and based on the detected electrostatic capacity, a used amount of developer is estimated. It is noted that if the used amount of the developer can be determined, any physical property other than the electrostatic capacity can also be employed.

A memory access interval determination unit 103 determines a memory access interval that is the number of times of access to the memory 111 permitted per unit time. The memory access interval determination unit 103 calculates a consumption rate or a consumed amount of the memory lifetime based on memory lifetime information stored in a memory lifetime storage unit 104 and the number of access to the memory 111 counted by a memory access counter 105. The memory lifetime information indicates, for example, an upper limit of the number of rewriting (the guaranteed number of rewriting) to the memory 111. The memory access counter 105 is an example of a counting unit that counts the number of access to the storage unit. The memory access interval determination unit 103 is an example of a consumption rate calculation unit that calculates a consumption rate of the memory 111 based on the counted number of access and lifetime data of the storage unit.

Generally, the term "memory access" means both reading of data and writing (rewriting) of data. In the first exemplary embodiment, the term "memory access" means the latter. However, the number of reading data can be included in the number of access.

Further, the memory access interval determination unit 103 can calculate a consumption rate of a cartridge lifetime based on a used amount of the cartridge and cartridge lifetime information stored in a cartridge lifetime storage unit 106. The memory access interval determination unit 103 is an example of a consumption rate calculation unit that calculates a consumption rate of a consumable part based on a used amount of the consumable part that is measured and lifetime data of the consumable part. The memory access interval determination unit 103 compares a consumption rate of the memory 111 with a consumption rate of a cartridge to determine whether a memory access interval is appropriate. For example, the memory access interval determination unit 103 determines whether a remaining number of the times of memory access is enough as compared to a remaining lifetime of the cartridge.

Further, the memory access interval determination unit 103 can determine whether an accuracy of information to be stored in the memory 111 is low. The memory access interval determination unit 103 determines a memory access interval, for example, by comprehensively considering a part or all of the above-described factors. The determined new memory access interval is stored as memory access interval information in a memory access interval storage unit 107. As described above, the memory access interval determination unit 103 is an example of an updating unit that updates the memory access interval based on the number of times of access that is counted and a used amount of a consumable part that is measured.

A memory access timing control unit 108 receives a memory access request from an engine control unit or the like in the image forming apparatus and determines whether to actually permit access to the memory 111. In making the determination, the memory access timing control unit 108 compares the memory access interval information stored in the memory access interval storage unit 107 with a counted value in a memory access interval counter 109. Then, depending on the comparison result, the memory access timing control unit 108 determines whether it is possible to permit the memory access.

The memory access interval counter 109 counts a time interval from previous access timing to access timing of this time. If the memory access can be permitted, the memory access timing control unit 108 issues a memory access instruction to a memory access unit 110 and clears (resets to zero) the memory access interval counter 109. On the other hand, if the memory access cannot be permitted, the memory access timing control unit 108 forbids issuing the memory access request, and updates the memory access interval counter 109.

In response to the memory access request, the memory access unit 110 executes writing to the memory 111, and updates the memory access counter 105. The memory 111 is an example of a storage unit that has an upper limit of the number of rewriting.

Figure 2:
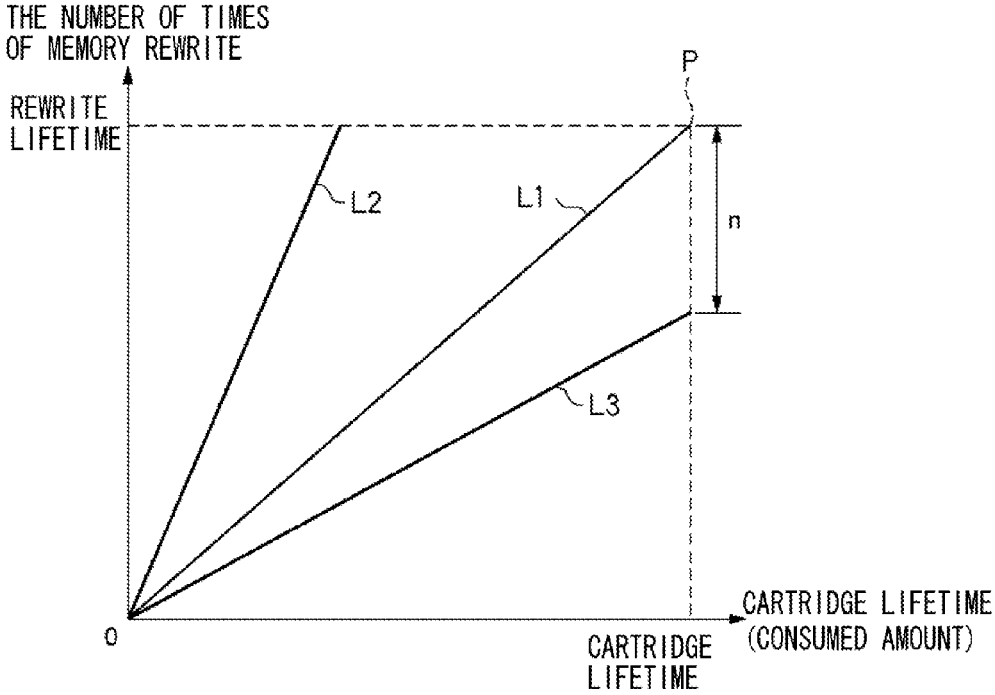
FIG. 2 is a graph illustrating determination contents to be performed by a memory access interval determination unit according to the first exemplary embodiment of the present invention.
Figure 3:
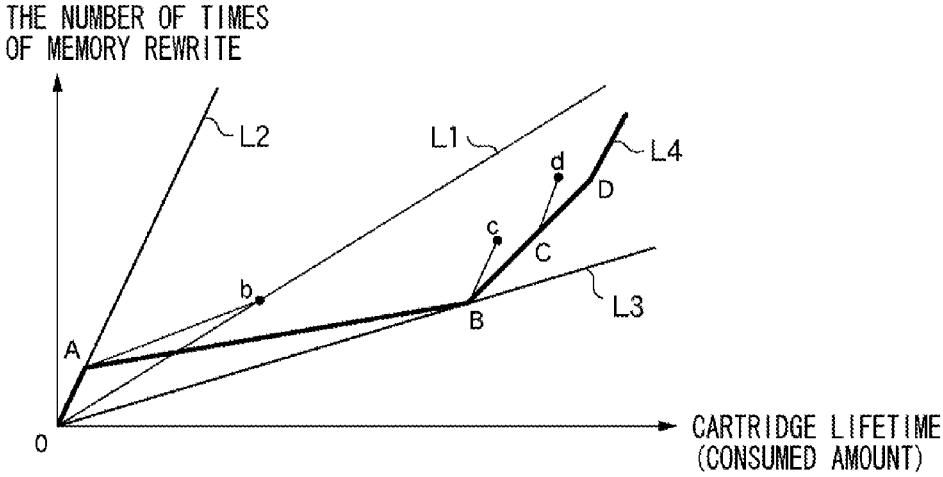
FIG. 3 is a graph illustrating determination to be performed by the memory access interval determination unit according to the first exemplary embodiment of the present invention.

FIGS. 2 and 3 are views illustrating determination to be performed by the memory access interval determination unit 103 according to the first exemplary embodiment of the present invention. In the drawings, horizontal axes indicate used amounts (consumed amounts) of the cartridge and vertical axes indicate the number of memory rewrite. A point on the horizontal axis corresponds to a cartridge lifetime, and a point on the vertical axis corresponds to a memory lifetime (rewrite lifetime).

A line L1 is a straight line that connects a point P where the cartridge lifetime and the memory lifetime intersect with each other and an original point O. The straight line L1 indicates an ideal relationship in which memory access is averagely made from a start of use of the cartridge to the end of the lifetime of the cartridge. A straight line L2 indicates a case in which the memory access is frequently performed in order to increase data accuracy and as a result, the cartridge lifetime still remains at the time the memory lifetime ends. A line L3 is a straight line that indicates a case in which a memory access frequency is reduced in order to keep the memory lifetime, and as a result, the memory lifetime still remains at the time the cartridge lifetime ends.

Reference numeral n in FIG. 2 denotes a difference between the number of times of memory rewrite and a memory lifetime at the time a cartridge lifetime ends. That is, the reference numeral n denotes a margin of the number of times of memory rewrite. If a margin n is too large, the quality of the memory is excessive, and is to be marked as a target to reduce cost.

The memory access interval determination unit 103 makes the following determination based on a counted value of the memory access interval counter 109, memory lifetime information, cartridge used amount information, and cartridge lifetime information. Each left-hand side of inequalities (1) and (2) denotes a consumption rate of a memory. Each right-hand side of the inequalities denotes a consumption rate of a consumable part (cartridge). The consumption rates can also be referred to as a usage rate.

$$\frac{\text{memory access counted value (the number of times of rewrite)}}{\text{memory lifetime}} > \frac{\text{consumable material (cartridge) used amount}}{\text{consumable material (cartridge) lifetime}} \quad (1)$$

$$\frac{\text{memory access counted value (the number of times of rewrite)}}{\text{memory lifetime}} < \frac{\text{consumable material (cartridge) used amount}}{\text{consumable material (cartridge) lifetime}} \quad (2)$$

In a case where the inequality (1) is satisfied, the consumption rate of the memory is larger than the consumable part. This implies that the memory access is frequently made (excess state). Then, the memory access interval determination unit 103 updates the memory access interval information such that the current access interval is increased from a present one. In a case where the inequality (2) is satisfied, the consumption rate of the memory is smaller than the consumable part. This indicates that the memory access is not frequently made (the accuracy of the data is relatively low) Then, the memory access interval determination unit 103 updates the memory access interval information such that the current access interval is narrowed.

Meanwhile, if the memory access timing is not limited, the memory access frequency can be controlled to be constant from an initial stage of the cartridge usage to a terminal stage. In such a case, by controlling the memory access interval to overlap with the straight line L1, a difference between the time the cartridge lifetime ends and the time the number of rewriting of the memory 111 reaches an upper limit becomes zero. However, actually, because limits due to the configuration of the image forming apparatus or electrical limits (for example, while a motor is driven, the memory access cannot be made) exist, it is extremely difficult to realize the state of the straight line L1. As illustrated in FIG. 3, an actual relationship between the number of memory rewrite and a consumption rate of the cartridge becomes just like a straight line L4. Accordingly, in a case where the memory access occurs at a timing deviating from the straight line L1 as shown by the straight line L4, the memory access timing control unit 108 can control the next memory access timing so that the memory access timing comes close to the straight line L1.

Sometimes, in order to maintain the data accuracy, an engine control unit can execute a rewrite processing of the memory data at the time a printing operation ends. Here, it is assumed that a print job volume is small and data updating operation is frequently performed at a timing corresponding to a point A in FIG. 3. In such a case, the point A is located above the straight line L1 (the access frequency is high), and the memory access interval determination unit 103 determines an access interval such that a next data update is executed at a timing corresponding to a point b.

However, if a print volume of a next job is large, the memory access timing control unit 108 may determine that writing to the memory 111 cannot be permitted at the timing corresponding to the point b. In such a case, the memory access unit 110 executes the data rewrite at a timing (at the time of print completion (point B in FIG. 3)) later than the timing corresponding to the point b.

However, the point B is located below the straight line L1 (a state in which the access frequency is small), the memory access interval determination unit 103 updates the access interval to be short so that the next memory data update timing becomes a point c that is close to the straight line L1. In a case where a print volume of a next job is also large, it is not possible to rewrite the data at the timing corresponding to the point c, and the rewrite processing is executed at the time the print is completed (a timing corresponding to a point C). A similar operation is performed in a case of points d and D.

As described above, it is desirable that the memory access interval is set such that the relationship between the cartridge consumption amount and the number of times of memory rewrite becomes closer to the ideal relationship, that is, the difference between the end of the cartridge lifetime and the time the number of rewriting the memory 111 reaches the upper limit becomes small.

As described above, it is possible to appropriately set the number of times of rewrite depending on usage of the cartridge. Further, by increasing the memory access frequency as much as possible, the data accuracy can be maintained at a high level.

Figure 4:
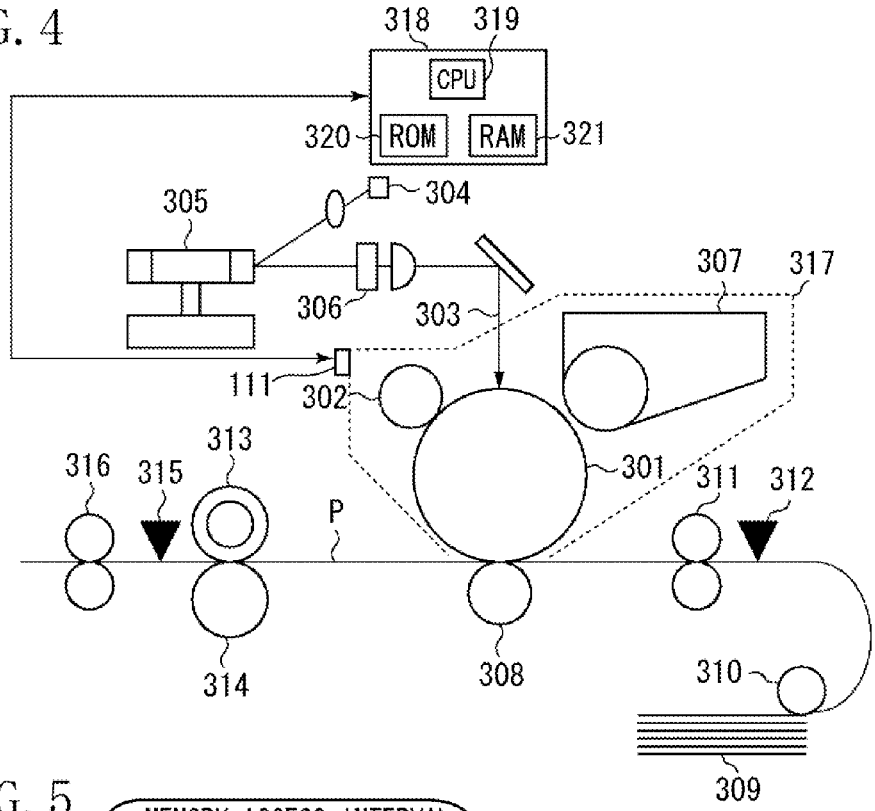
FIG. 4 is a cross sectional view illustrating an example of an image forming apparatus according to the first exemplary embodiment of the present invention.

FIG. 4 is a cross sectional view illustrating an example of the image forming apparatus according to the first exemplary embodiment of the present invention. A photosensitive drum 301 is an example of an electrostatic latent image bearing member. A charging roller 302 is a part of a charging device that uniformly charges a surface of the photosensitive drum 301. An optical beam 303 is emitted by a light emitting unit to a part (irradiation part) of the surface of the photosensitive drum 301 that is located downstream in a rotation direction from a contact position between the photosensitive drum 301 and the charging roller 302.

The light emitting unit includes a semiconductor laser 304 that emits the optical beam 303, a scanner 305 that scans a surface of the photosensitive drum 301 with the optical beam 303, and an optical lens 306 that adjusts the optical beam 303 to form a spot on the surface of the photosensitive drum. The light emitting unit irradiates the surface of the photosensitive drum 301 with the optical beam 303 according to image data to form an electrostatic latent image.

The electrostatic latent image is developed as a toner image by a development device 307 that is disposed so as to contact with the photosensitive drum 301 downstream from the irradiation point in a direction of the photosensitive drum 301. It is assumed that the development device 307 is realized as the above-described toner cartridge. Under the photosensitive drum 301, the toner image is transferred onto a sheet P, which is a transfer material, by a transfer roller 308 that is disposed facing the photosensitive drum 301. The position where the toner image is transferred is referred to as a transfer position. The sheet P is stored in a paper cassette 309. However, the sheet P can be also manually supplied. A sheet feeding roller 310 that is disposed at an end of the paper cassette 309 feeds the sheet P in the paper cassette 309 to a conveyance path.

On the conveyance path between the sheet feeding roller 310 and the transfer roller 308, a registration roller 311 is disposed. The registration roller 311 performs a skew correction of the sheet P and synchronizes an image formation on the photosensitive drum 301 with the sheet conveyance. The registration roller 311 feeds the sheet P to the transfer position at a predetermined timing. Between the registration roller 311 and the sheet feeding roller 310, a sheet presence detection sensor 312 is disposed.

The sheet P on which the unfixed toner image is transferred is further conveyed to a fixing device. The fixing device includes a fixing roller 313 that internally has a fixing heater (not shown), and a pressure roller 314 that is disposed to press the fixing roller 313. The sheet P conveyed from the transfer section is pressed and heated by a pressure section including the fixing roller 313 and the pressure roller 314 so that the unfixed toner image is fixed. Behind the pressure section, a sheet presence detection sensor 315 that confirms that the sheet P is discharged from the pressure section is disposed. Further, behind the sheet presence detection sensor 315, a paper discharge roller 316 is disposed. The paper discharge roller 316 discharges the sheet P on which the toner image is fixed.

A process cartridge is detachably mounted on the body of the image forming apparatus. The process cartridge is formed by integrating the photosensitive drum 301, the charging roller 302, the development device 307, the nonvolatile memory 111 (the above-described memory 111 shown in FIG. 1). In addition to the photosensitive drum 301, the charging roller 302, and the development device 307, a cleaner (not shown) that cleans the photosensitive drum 301 can be included in the process cartridge. Controller 318 includes a part except the memory 111 shown in FIG. 1, and controls the operation of the image forming apparatus explained above and the operation explained in FIG. 1. The controller 318 controls the operations mentioned above based on a control program stored in ROM 320 or a data stored in the RAM 321.

Here, it is assumed that the cartridge lifetime is defined by a film thickness of the surface of the photosensitive drum 301. A surface layer of the photosensitive drum 301 has a multilayer structure to effectively perform the discharge, development, transfer, and cleaning. The surface layer of the photosensitive drum 301 gradually deteriorates as print operation is performed. If a film thickness of the surface layer is below a certain level, the print quality may not be maintained. The film thickness at the time is defined as a level at which the life of the cartridge expires. Accordingly, in the first exemplary embodiment, it is necessary to provide a processing section that detects, measures, or estimates the cartridge lifetime such as the film thickness according to a print operation. However, it is difficult to directly detect the film thickness. Accordingly, some kind of alternative means needs to be provided.

For example, the cartridge used-amount measurement unit 101 can calculate a consumed amount or a remaining amount of the lifetime based on a physical parameter such as a rotation speed, a drive time, a voltage applying time of the photosensitive drum 301. Further, the cartridge used-amount measurement unit 101 can calculate a consumed amount or a remaining amount of the cartridge's lifetime based on an electrostatic capacity detected based on a remaining toner in a toner container using a plurality of electrodes provided in the toner container.

Figure 5:
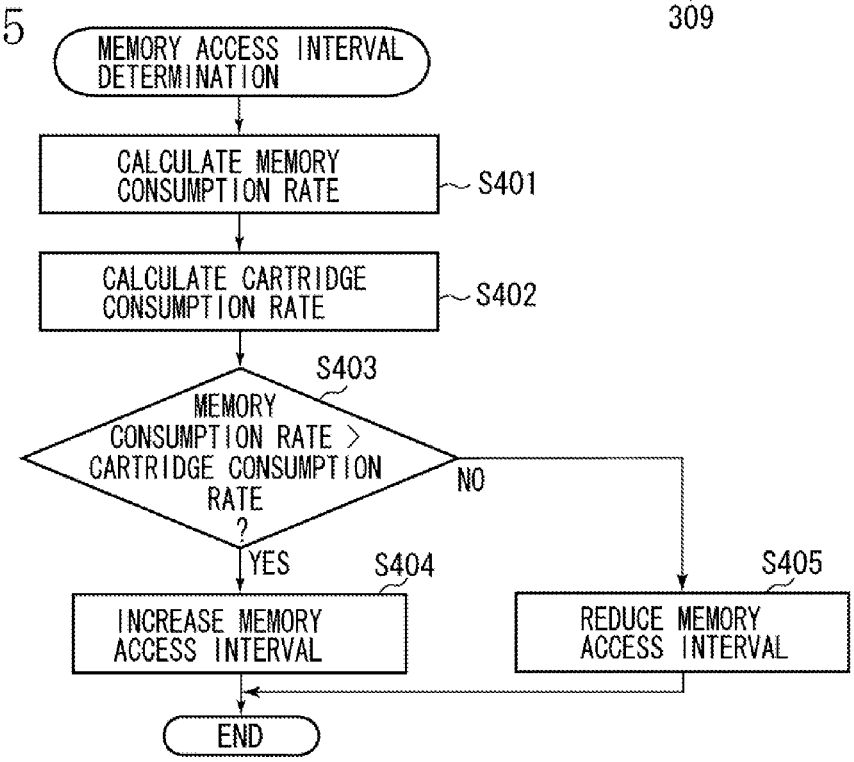
FIG. 5 is a flowchart illustrating an example of a memory access interval determination processing according to the first exemplary embodiment of the present invention.

FIG. 5 is a flowchart illustrating an example of a memory access interval determination processing according to the first exemplary embodiment of the present invention. In step S401, the memory access interval determination unit 103 calculates a current memory consumption rate based on a counted value of the memory access interval counter 109 and memory lifetime information. In step S402, the memory access interval determination unit 103 calculates a cartridge consumption rate based on cartridge used-amount information and cartridge lifetime information.

In step S403, the memory access interval determination unit 103 compares the memory consumption rate with the cartridge consumption rate. In a case where the memory consumption rate is larger than the cartridge consumption rate (Yes in step S403), it is determined that a memory access frequency is high. Then, the processing proceeds to step S404, and the memory access interval determination unit 103 increases (expands) the current memory access interval by one step. Accordingly, the access frequency can be reduced. On the other hand, in a case where the memory consumption rate is equal to or less than the cartridge consumption rate (No in Step S403), it can be determined that the memory access frequency is low. Then, the processing proceeds to step S405, and the memory access interval determination unit 103 decreases (reduces) the current memory access interval. Accordingly, the access frequency can be increased. It is noted that the increment and the decrement of the access interval can be constant or variable. In a case of variable intervals, the memory access interval determination unit 103, for example, determines the increment and the decrement of the interval according to a shift amount based on the above-described straight line L1.

Figure 6:
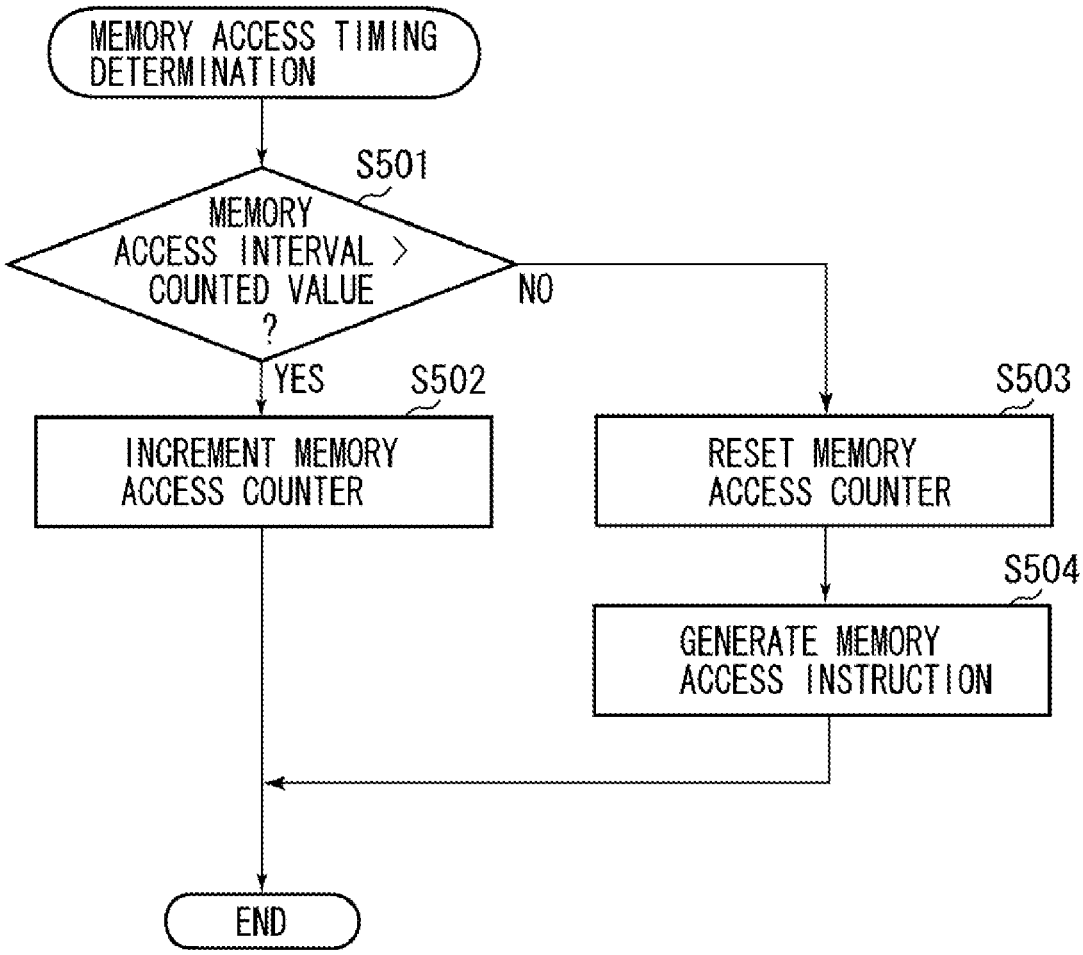
FIG. 6 is a flowchart illustrating an example of a memory access timing control processing according to the first exemplary embodiment of the present invention.

FIG. 6 is a flowchart illustrating an example of a memory access timing control processing according to the first exemplary embodiment of the present invention. The memory access timing control unit 108 performs an access control according to the flowchart each time a memory access request is issued.

In step S501, the memory access timing control unit 108 compares a memory access interval read from the memory access interval storage unit 107 with a counted value of the memory access interval counter 109. In this step, whether the memory access interval is larger than the counted value is determined. If it is determined that the memory access interval is larger than the counted value (YES in step S501), the memory access is not permitted. Then, the processing proceeds to step S502. In step S502, the memory access timing control unit 108 increments the memory access interval counter 109 by one and the processing ends.

On the other hand, if it is determined that the memory access interval is equal to or less than the counted value (NO in step S501), the processing proceeds to step S503. In step S503, the memory access timing control unit 108 resets the memory access interval counter 109 to zero. In step S504, the memory access timing control unit 108 instructs the memory access unit 110 to perform a memory access. The memory access unit 110 performs a writing operation and increments the counted value of the memory access interval counter 109 by one.

According to the first exemplary embodiment, the access to the storage unit is limited such that the difference between expiration of the consumable part lifetime and the time the number of rewriting of the storage unit reaches the upper limit becomes small according to the number of times of access and the used amount of the consumable part. Accordingly, it is possible to increase the data accuracy as much as possible while the rewrite lifetime of the storage unit is maintained until the consumable part lifetime ends. Thus, the more inexpensive storage unit that has a short write lifetime can be readily employed.

For example, the access interval that is the number of times of access to the storage unit permitted per unit time can be updated depending on the counted number of times of access and the used amount of the consumable part that is measured. More specifically, the memory access interval determination unit 103 determines the access interval such that consumption rates of the storage unit are changed depending on changes of consumption rates of the consumable part. Thus, the write lifetime of the storage unit can be maintained more easily until the lifetime of the consumable part ends.

The memory access interval determination unit 103 can include a comparison unit that compares a rate of change that is calculated based on a consumption rate of the storage unit and a consumption rate of the consumable part with a slope determined based on a lifetime of the storage unit and a lifetime of the storage unit. One example of the slope is a slope of a graph shown in FIG. 3. In such a case, the memory access interval determination unit 103 determines an access interval based on a comparison result in the comparison unit. According to the use of the comparison unit, the relationship between the number of times of memory rewrite and consumption amounts of the cartridge becomes closer to the ideal straight line L1.

Second Exemplary Embodiment

In the first exemplary embodiment, it is assumed that a used amount (consumed amount of a lifetime) of a consumable part can be always detected from a start of the usage of the consumable part. However, it is possible to employ an estimation unit that estimates a used amount of a consumable part based on an electrostatic capacity detected using electrodes provided in a toner container (for example, see Japanese Patent Application Laid-Open No. 2000-275950).

The cartridge used-amount estimation unit of the electrostatic capacity detection type is excellent in detection accuracy when an amount of remaining toner becomes small. Further, the cartridge used-amount estimation unit of the electrostatic capacity detection type has an advantage that in a case where a plurality of images of different coverage rates is formed, it is possible to correctly detect a remaining toner amount. The coverage rate is an amount of used tone per unit area. However, when an enough amount of the toner remains in the toner container, for example, at the time the lifetime of the cartridge starts, the detection accuracy of the cartridge used-amount estimation unit of the electrostatic capacity detection type is relatively low. Thus, an estimation accuracy of the cartridge used-amount estimation unit of the electrostatic capacity detection type is lower in an initial stage of the lifetime of the consumable part than the estimation accuracy in a terminal stage of the lifetime of the consumable part, it is necessary to take some sort of measures.

Figure 7:
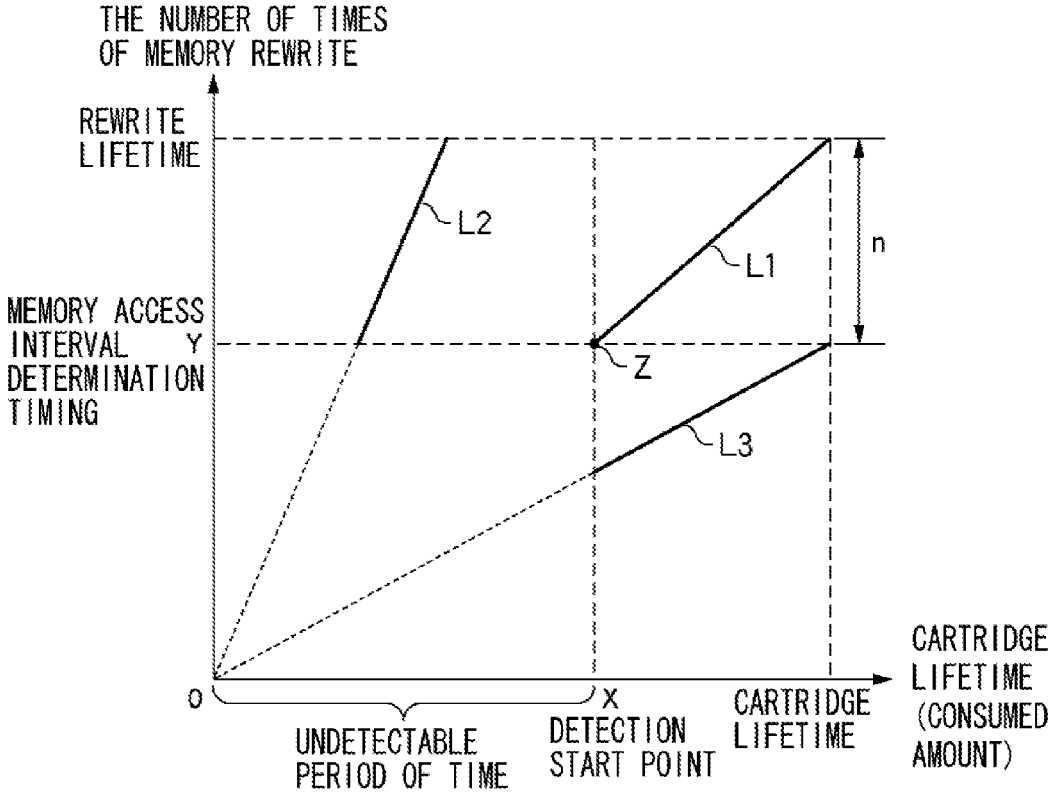
FIG. 7 is a graph illustrating a transition of consumed amounts of a lifetime of a cartridge and a lifetime of a memory in a case where an estimation unit that cannot accurately detect a consumed amount of the cartridge until the consumed amount of the cartridge reaches a predetermined amount, is employed according to a second exemplary embodiment of the present invention.

FIG. 7 is a graph illustrating a transition of used amounts (consumed amounts) of a lifetime of a cartridge and a transition of consumed amounts of a lifetime of a memory in a case where an estimation unit that cannot accurately detect a consumed amount of the cartridge until the consumed amount of the cartridge reaches a predetermined amount is employed according to the second exemplary embodiment of the present invention. Descriptions about portions or components similar to those in FIGS. 2 and 3 will not be repeated.

After usage of the cartridge starts, in an initial stage, a consumed amount of the cartridge lifetime is not detected. Therefore, from the middle of the lifetime of the consumable part (particularly, at a detection start point X from where the consumed amount of the cartridge lifetime can be accurately detected), the cartridge used-amount estimation unit of the electrostatic capacity detection type starts to function.

The detection start point X is an intersection formed by dropping a perpendicular line to a horizontal axis from a point Z on the straight line L1. A point Y is an intersection formed by dropping a perpendicular line to a vertical axis from the point Z on the straight line L1. The point Y is a determination start point of a memory access interval.

In such a case, within a quadrangle having four vertexes of an original point O, and the points X, Y, and Z, because of the above-described reasons, it is not possible to adjust the memory access interval based on the consumed amount of the cartridge lifetime. Especially, before the consumed amount of the cartridge lifetime exceeds the detection start point X, the number of times of memory rewrite may exceed the determination start point of the memory access interval. As described above, if the memory access interval is too short, the memory lifetime may end before the cartridge lifetime ends.

Figure 8:
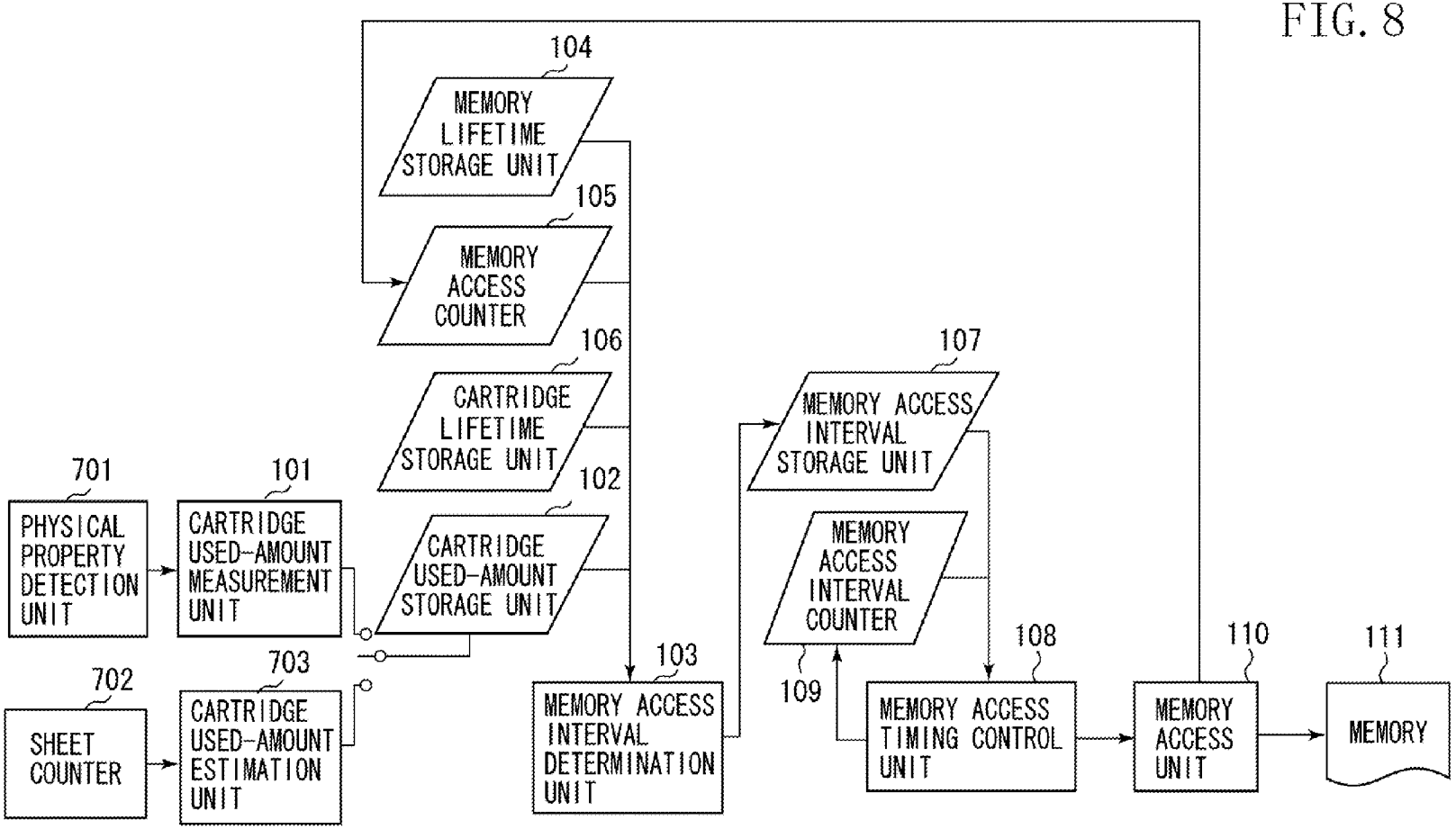
FIG. 8 is a block diagram illustrating a part of a control unit in an image forming apparatus according to the second exemplary embodiment of the present invention.

FIG. 8 is a block diagram illustrating a part of a control unit in an image forming apparatus according to the second exemplary embodiment of the present invention. In the second exemplary embodiment, until reaching the detection start point X concerning the cartridge, the used amount of the consumable part is estimated using the number of printed sheets.

A physical property detection unit 701 is an example of a detection unit that detects a change of a physical property of a consumable part. Here, it is assumed that the physical property detection unit 701 detects an electrostatic capacity of a cartridge. The cartridge used-amount measurement unit 101 is an example of a first estimation unit that estimates a used amount of a consumable part based on a detected change of a physical property.

A sheet counter 702 counts the number of image formed sheets in the image forming apparatus. A cartridge used-amount estimation unit 703 is an example of a second estimation unit that estimates a used amount of a consumable part based on the counted number of image formed sheets. Until the middle of the lifetime of a consumable part, a used amount determined by the cartridge used-amount estimation unit 703 is employed. After passing the middle of the lifetime of the consumable part (after the point X), a used amount determined by the cartridge used-amount measurement unit 101 is employed.

For example, it is assumed that the cartridge lifetime is 100,000 sheets, and the detection start point X of the cartridge used amount corresponds to a cartridge consumption rate 75%. Further, it is assumed that the number of image-formed sheets at the time the cartridge lifetime consumed amount reaches the detection start point X of the cartridge used amount is, $$100{,}000\times(75\div100)=75{,}000 \text{ (sheets)}.$$

Actually, the number of image formed sheets at the time the cartridge lifetime consumed amount reaches the detection start point X of the cartridge used amount varies depending on a coverage rate when images are formed, the number of sequentially image formed sheets in one job, or the like. However, since the number of image formed sheets is used only as a rough guide for a cartridge used-amount undetectable time, they are enough for the purpose.

Similarly, it is assumed that the memory write lifetime is 1,000,000 times. In such a case, a memory access interval determination start timing is, $$1{,}000{,}000\times(75\div100)=750{,}000 \text{ (times)}.$$

Further, it is assumed that during a period a cartridge used amount is undetectable, the memory access interval is, $$750{,}000\div75{,}000=10 \text{ (times/sheet)}.$$

That is, the memory access timing control unit 108 performs control such that memory access is executed only ten times per one sheet.

It can be anticipated that the number of times of memory access exceeds the memory access interval determination start point Y before a cartridge used amount determined by the cartridge used-amount measurement unit 101 reaches the detection start point X. For example, such a phenomenon occurs in a case where printing is repeatedly performed at a low coverage rate or a print volume per one print job is large, a consumption rate of the cartridge lifetime is decreased. In such a case, the memory access interval determination unit 103 reduces the memory access interval to be low as compared with a normal case until the cartridge used amount determined by the cartridge used-amount measurement unit 101 reaches the detection start point V. That is, the memory access interval determination unit 103 reduces the memory access interval to a value smaller than ten times per sheet.

Figure 9:
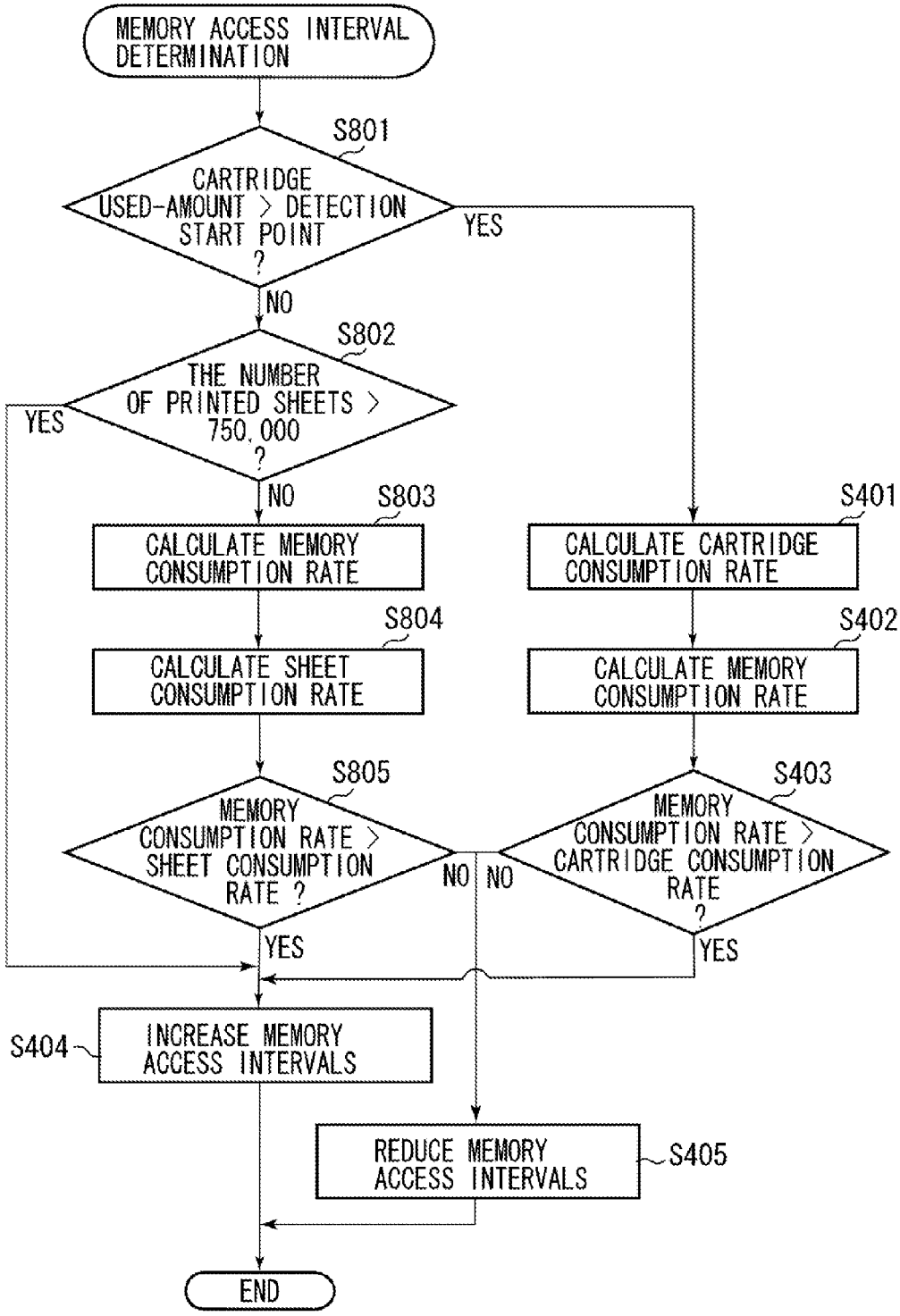
FIG. 9 is a flowchart illustrating an example of a memory access interval determination processing according to the second exemplary embodiment of the present invention.

FIG. 9 is a flowchart illustrating an example of a memory access interval determination processing according to the second exemplary embodiment of the present invention. As to the elements that are already described, the same reference numbers are applied for the sake of simplicity.

In step S801, the cartridge used-amount measurement unit 101 determines whether a cartridge used amount measured by the cartridge used-amount measurement unit 101 exceeds the detection start point X. If it is determined that the measured amount exceeds the point X (YES in step S801), the processing proceeds to step S401. If it is determined that the measured amount does not exceed the point X (NO in step S801), the processing proceeds to step S802.

In step S802, the cartridge used-amount measurement unit 101 determines whether the number of printed sheets counted by the sheet counter 702 exceeds a predetermined threshold (for example, 750,000 sheets). If it is determined that the number of printed sheets has already exceeded 750,000 sheets (YES in step S802), the processing proceeds to step S404. According to the processing, the memory access interval is increased as compared to the current value.

If it is determined that the number of printed sheets has not exceeded 750,000 sheets (NO in step S802), the processing proceeds to step S803. In step S803, the memory access interval determination unit 103 calculates a memory consumption rate by dividing the counted number of the memory access counter 105 by the memory lifetime. In step S804, the cartridge used-amount estimation unit 703 estimates a cartridge used amount based on the number of printed sheets, and write the estimated amount in the cartridge used-amount storage unit 102. For example, the cartridge used-amount estimation unit 703 divides the number of printed sheets by the number of sheets (for example, 100,000 sheets) corresponding to the cartridge lifetime. Thus, the consumption rate of the sheets that corresponds to the cartridge used amount based on the number of printed sheets is calculated.

In step S805, the memory access interval determination unit 103 determines whether a memory consumption rate exceeds the consumption rate of the sheets. If it is determined that the memory consumption rate has exceeded the consumption rate of the sheets (YES in step S805), the processing proceeds to step S404. Thus, the access interval is increased. If it is determined that the memory consumption rate has not exceeded the consumption rate of the sheets (NO in step S805), the processing proceeds to step S405. Thus, the access interval is decreased.

As described above, the memory access interval determination unit 103 employs a used amount determined based on the number of printed sheet until the middle of a lifetime of a consumable part. After passing the middle of the lifetime of the consumable part, the memory access interval determination unit 103 employs a used amount determined based on a physical property. It is noted that the memory access interval determination unit 103 is a part of the access control unit. Accordingly, even if an estimated accuracy at an initial stage of the lifetime of the consumable part is lower than that at a terminal stage of the lifetime of the consumable part, effects similar to those in the first exemplary embodiment can be expected.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-199898 filed in Jul. 31, 2007 which is hereby incorporated by reference herein in its entirety.

What is claimed is:

1. An image forming apparatus that includes a detachable consumable part having a storage unit configured to store information, the image forming apparatus comprising:

a counting unit configured to count the number of times data is rewritten in the storage unit;

a measurement unit configured to measure a used amount of the consumable part;

an access control unit configured to determine an access frequency to the storage unit based on information on the number of times counted by the counting unit and information on the used amount measured by the measurement unit; and a rewriting unit configured to rewrite data in the storage unit at the access frequency determined by the access control unit.

2. The image forming apparatus according to claim 1, wherein the access frequency to the storage unit is an access interval to the storage unit.

3. The image forming apparatus according to claim 2, further comprising:

a first usage rate calculation unit configured to calculate a usage rate of the storage unit based on the counted number of times of access and data indicating a lifetime of the storage unit; and a second usage rate calculation unit configured to calculate a usage rate of the consumable part based on the counted used amount of the consumable part and data indicating a lifetime of the consumable part;

wherein the access control unit determines the access interval such that the usage rate of the storage unit changes according to a change of the usage rate of the consumable part.

4. The image forming apparatus according to claim 3, further comprising:

a comparison unit configured to compare the rate of change calculated based on the usage rate of the storage unit and the usage rate of the consumable part with a reference value determined based on the data indicating the lifetime of the storage unit and the data indicating the lifetime of the consumable part, wherein, the access control unit is configured to determine the access interval based on the comparison result of the comparison unit.

5. The image forming apparatus according to claim 1, wherein the measurement unit further comprises:

a detection unit configured to detect a change of a physical property of the consumable part;

a first estimation unit configured to estimate the used amount of the consumable part based on the detected change of the physical property;

a counter configured to count a number of image-formed sheets in the image forming apparatus; and a second estimation unit configured to estimate the used amount of the consumable part based on the number of image-formed sheets that is counted, wherein, the access control unit employs the used amount determined by the second estimation unit from a start of use of the consumable part until the detection of the change of the physical property by the first estimation unit, and after the change of the physical property is detected by the first estimation unit, the access control unit employs the used amount determined by the first estimation unit.

6. The image forming apparatus according to claim 1, wherein the consumable part is a cartridge that contains developer, and wherein the measurement unit measures a used amount of the developer.

7. A method for controlling access to a storage unit provided in a detachable consumable part in an image forming apparatus, the method comprising:

measuring a used amount of the consumable part;

counting the number of times data is rewritten in the storage unit;

determining an access frequency to the storage unit based on information on the counted number of times and information on the measured used amount; and rewriting data in the storage unit at the determined access frequency.

8. The method according to claim 7, further comprising setting an access interval to the storage unit based on the counted number of times and the used amount of the consumable part.

9. The method according to claim 8, further comprising:

calculating a usage rate of the storage unit based on the counted number of times and data indicating a lifetime of the storage unit;

calculating a usage rate of the consumable part based on the measured used amount of the consumable part and data indicating a lifetime of the consumable part; and determining the access interval such that the usage rate of the storage unit changes according to a change of the usage rate of the consumable part.

10. The method according to claim 7, further comprising:

counting a number of image-formed sheets used by the image forming apparatus;

detecting a change of a physical property of the consumable part and estimating the used amount of the consumable part based on a number of image-formed sheets that are counted; and controlling the access frequency based on the number of times data is rewritten and the estimated used amount of the consumable part.

* * * * *